United States Patent [19]

Roberts

[11] 4,228,426

[45] Oct. 14, 1980

[54] HOSPITAL BED MONITOR

[76] Inventor: William A. Roberts, 340 Morietti Dr., Concord, Calif. 94520

[21] Appl. No.: 946,960

[22] Filed: Sep. 29, 1978

[51] Int. Cl.[2] ..... G08B 21/00

[52] U.S. Cl. ..... 340/573; 340/311; 340/507; 340/666; 340/687

[58] Field of Search ..... 340/573, 666, 568, 311, 340/507, 687

[56] References Cited

U.S. PATENT DOCUMENTS

| | | | |
|---|---|---|---|
| 2,780,693 | 2/1957 | McClellan | 340/573 |
| 2,910,680 | 10/1959 | McLain | 340/311 |
| 2,976,524 | 3/1961 | Wall | 340/311 |
| 4,020,482 | 4/1977 | Feldl | 340/573 |

*Primary Examiner*—Glen R. Swann, III

*Attorney, Agent, or Firm*—Alvin E. Hendricson

[57] ABSTRACT

A monitoring system has a connecting unit that is adapted for connection between a nurse call button and a communication panel in a hospital room and is attached to a movable pressure activated switching means for placement in a bed or chair to operate an alarm in the nurse call system for remotely signaling the absence of a patient.

6 Claims, 5 Drawing Figures

HOSPITAL BED MONITOR

BACKGROUND OF INVENTION

Patients in hospitals, convalescent homes, and the like, sometimes fall from beds or chairs, and unless properly attended, may suffer additional harm or injury. Particularly in the case of elderly patients, it has been found that falling or possibly climbing from hospital beds, even with raised side rails, is not an uncommon occurrence. Aside from intensive care situations, hospital and convalescent care patients are not normally under constant surveillance and thus could be injured and lie on the floor, for example, for a considerable period of time without assistance.

It is conventional in hospitals and convalescent homes to provide a nurse call button and a speaker adjacent the hospital bed so that the patient may operate the call button to signal a nursing station that assistance is required. Conventionally, a communication panel is provided in a wall adjacent each hospital bed with a loud speaker at the panel, so that a patient may communicate with a central station as required. Normally, the nurse call unit is plugged into this panel and a cord extends from the plug to a call button unit that may be clipped to a pillow or the sheets of the bed. Such a nurse call system normally includes not only a circuit that can be closed by actuating the call button, but also a normally closed circuit that is opened at any time the unit becomes unplugged from the panel. Either button actuation or unplugging of the unit will operate a light and/or audio-alarm at some central station. Although these prior art systems are quite advantageous and are widely employed, it is known that they do not solve the problem of a patient that may fall from a bed, inasmuch as the call button would not normally then be in a position to be actuated by such a patient.

The present invention provides an improvement in patient care in hospitals or the like, by adding to the nurse call system normally employed in hospitals. The present invention positively identifies at a central station the presence or absence of a patient in a bed or chair without requiring additional wiring or the like to individual rooms.

SUMMARY OF INVENTION

The present invention comprises a system for automatically remotely indicating the absence of a person from a predetermined location, such as a hospital bed or a chair in a hospital room. The system hereof includes a pressure actuated switch in the form of a thin flat mat or the like, having internal contacts that are closed by weight applied to the mat. The mat of the present invention is electrically connected to a unit which is adapted to be plugged into the communication panel of a nurse call system and is adapted to receive the plug of a nurse call system. Thus, the connecting unit of the present invention fits between the panel and the normal nurse call plug, and in no way interferes with the normal function of the conventional nurse call system.

The pressure switch of the present invention is electrically connected in one line of the plug removal alarm circuit of a conventional nurse call system. This plug removal circuit of a conventional system merely includes a return circuit between two lines from a central station which normally completes the circuit when the plug is inserted in the communication panel. By inserting the pressure-operated switch of the present invention in this circuit, via the connecting unit of the present invention, it is possible then to actuate an alarm or circuit at any time the pressure actuated switch of the present invention is opened. This will then cause a visual or audio-alarm to be actuated in some central station, such as a nurse's station, indicating either that the nurse call unit has become unplugged from the communication panel or that the patient has left the bed or chair in which the pressure actuated switch of the present invention is located. In either of these instances, immediate investigation of the room in question should be made, and it is noted that it is not possible with the presently existing nurse call system to deactivate the alarm at the central station. Thus an operator at the central station is required to take some action, such as visiting the room in question, either to reinsert the nurse call plug in the communication panel or to check on the patient who may have fallen from bed.

The connecting unit of the present invention is also provided with a manually-operated switch so as to deactivate the system hereof under circumstances when the patient is intentionally removed from the pressure switch of the system.

DESCRIPTION OF FIGURES

The present invention is illustrated as to a single preferred embodiment thereof in the accompanying drawings wherein.

DESCRIPTION OF PREFERRED EMBODIMENT

Figure 1:
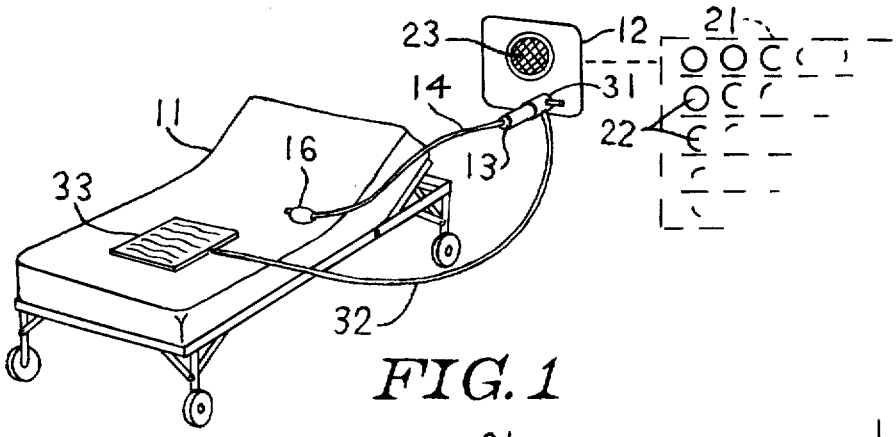
FIG. 1 is a schematic representation of an application of the present invention to a hospital bed in connection with a conventional nurse call system.

The present invention is adapted to be employed with a conventional nurse call system or the like that may be provided in the rooms of a hospital, convalescent home, or the like. In FIG. 1 there is schematically illustrated a hospital bed 11, having a communication panel 12 in a wall adjacent the bed. This communication panel 12 includes one or more receptacles for receiving a nurse call plug 13, having a flexible wire 14 extending therefrom to a nurse call button 16. In a conventional nurse call system, the communication panels 12 is electrically connected to a central station 21 which may include lights 22 associated with separate rooms for identifying the location of a nurse call signal from a patient. The communication panel may also include an audio communication system including a speaker 23, as indicated.

The present invention is adapted to cooperate with the nurse call system briefly described above and shown in FIG. 3, and is basically comprised as a connector 31 having a cord 32 extending therefrom to a pressure-operated mat switch 33. The connector 31 of the present invention is adapted to be inserted in a receptacle 41 in the communication panel 12 which may be provided with a plurality, such as eight female connectors adapted to receive the prongs of the nurse call plug 13. The connector 31 of the present invention has a first end which is identical to the male connector of the nurse call plug 13 and a second end which is identical to the panel receptacle 41 and is thus adapted to be inserted between the nurse call plug and receptacle. In FIG. 3, the connector is illustrated between these elements, but separated therefrom for clarity of illustration. The present invention operates to actuate the nurse call system by means of a pressure-operated switch 33 and the manner of operation may be best understood by referring to the electrical diagram of FIG. 2 of the drawings.

Figure 2:
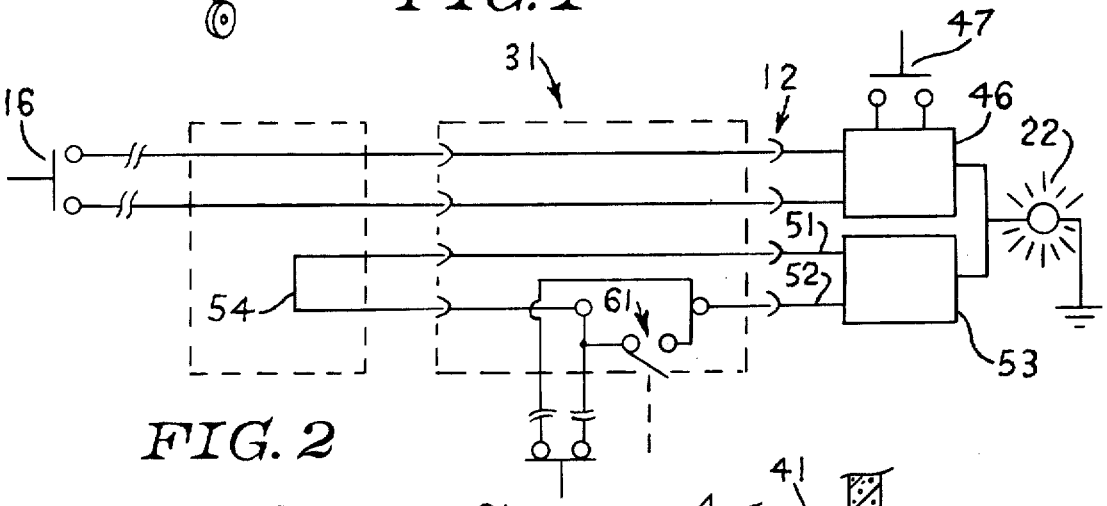
FIG. 2 is an electrical wiring diagram of the present invention as inserted in a conventional nurse call system.
Figure 3:
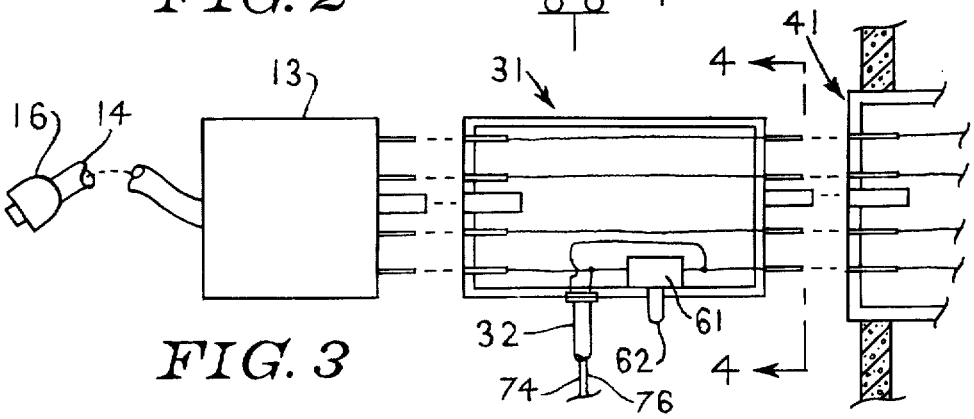
FIG. 3 is a schematic illustration of the connecting unit of the present invention between a communication panel and a nurse call system plug.
Figure 4:
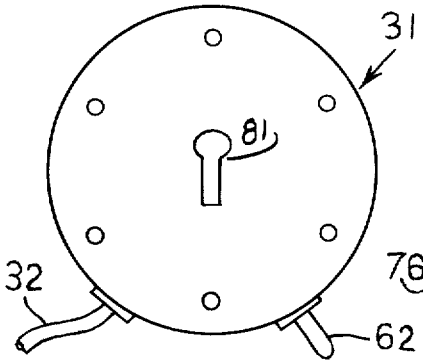
FIG. 4 is an end elevational view of the connecting unit of the present invention as taken in the plane 4—4 of FIG. 3.

Referring now to FIG. 2, it will be seen that the nurse call button 16 comprises a normally open switch across a pair of conductors which are electrically connected to a latching unit 46 at the central station for operating an indicator or alarm lamp 22. With the nurse call plug 13 connected to the receptacle 41 of the control panel, the above-noted circuit is completed so that at any time the switch 16 is closed, the lamp 22 will be energized. Of course, other types of alarms or indicators may be employed. The latching circuit 46 operates to continue energization of the lamp 22 after the switch 16 is momentarily closed, and a conventional release switch 47 is provided on the latching circuit to deenergize the lamp 22.

The nurse call system incorporates a further circuit for the purpose of energizing the alarm or lamp 22 at any time the nurse call plug 13 is electrically disconnected from the receptacle of the communication panel. It is realized that a patient may inadvertently pull on the cord 14 or button 16 so as to disengage or disconnect the plug 13 from the panel, and thus render the system inoperative. In order to indicate this occurrence at a central station, there is provided an additional pair of conductors 51 and 52 extending from a lamp energizing circuit 53 and adapted to be connected together by a shorting connection 54 in the nurse call plug 13. Any time that the plug 13 is electrically disconnected from the panel 12, the connection of conductors 51 and 52 will be opened or broken for operating the circuit 53 to energize the lamp 22. Lamp energization will then continue until the conductors 51 and 52 are reconnected as by reinsertion of the plug 13 in the panel 12.

The present invention operates upon this circuit of conductors 51 and 52 by connecting the pressure switch 33 in one of these lines, such as in the line 52, as illustrated in FIG. 2. The switch 33 of the present invention is normally closed by the application of pressure to the mat switch as, for example, by the pressure of a person laying or sitting on the mat. Thus the switch 33 will normally be closed when a person is lying in a bed 11 having the mat 33 thereon. This will complete the circuit between conductors 51 and 52 so as to apply no energization to the lamp 22. At any time a person removes their weight from the switch 33, the switch will be opened to thus disconnect the conductors 51 and 52, so that the circuit 53 then energizes the lamp 22. An operator at a central station will note the illumination of lamp 22 and will be unable to turn off the lamp by operating a switch 47. This will then apprise the operator of the disconnection of the nurse call system or the departure of a person from the bed or chair on which the switch of the present invention has been placed. Such a condition calls for immediate investigation so that a patient who may have fallen from a bed will immediately be found and can be returned to the bed or treated in such manner as may be required.

The present invention additionally includes an on-and-off switch in the connector 31. This switch 61 is shown in FIG. 2 to be connected across the pressure switch 33 and to have an actuator 62 extending exteriorly of the connector 31. This switch 61 is provided for the purpose of closing the circuit of conductor 52 under circumstances wherein the pressure-operated switch 33 would normally be opened. This circumstance would arise when no patient is in the bed 11 and it is desired not to continually actuate the alarm light 22 at the central station 21.

Figure 5:
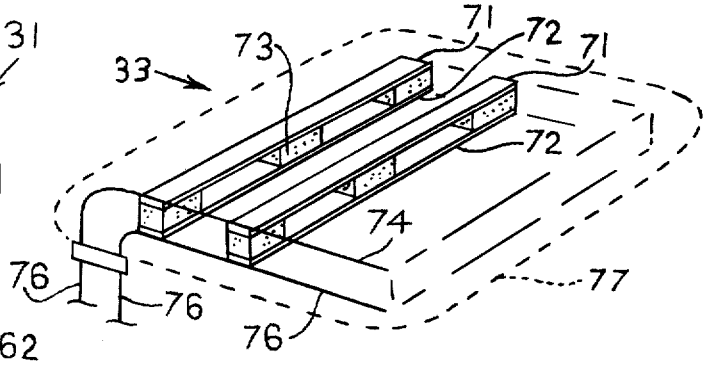
FIG. 5 is a schematic perspective illustration of a pressure switch that may be employed in the system of the present invention.

The pressure-operated switch 33 of the present invention may be relatively conventional in comprising a plurality of pairs of electrical conductors 71 and 72 with small spacers 73 between the conductors of each pair, as illustrated in FIG. 5. These conductors 71 and 72 may be formed of spring steel or the like, so that a pressure applied to the conductors will deform them sufficiently to contact each other. An upper wire 74 contacts all of the upper contacts or conductors 71, and the lower wire 76 contacts all of the lower contacts or conductors 72 and these wires extend from the switch as the cable 32 from the switch to the connector 31. The above-described element of the switch 33 are enclosed in a waterproof envelope 77 and this entire switch may have a thickness of only about one-tenth of an inch. The switch 33 may be formed of varying dimensions, however, a size of 18"×24" has been found to be advantageous for hospital beds. A switch of this nature may be operated i.e., closed with a minimum weight of about 30 pounds applied thereto, and it is noted that such a switch is highly durable and dependable in operation.

The present invention is illustrated with respect to an eight prong conductor inasmuch as this is a type of a connector normally provided on the communication panel of a nurse call system in a hospital or the like. Such a conductor normally includes in addition to the eight prongs thereof some type of central locator i.e., an asymetrical projection 81 adapted to fit in only one way into a mating depression in the female portion of the connector. This element is provided to properly orient the engagement of prongs and female receptacles.

The connector of the present invention is provided with such a configuration as to readily fit between the nurse call plug 13 and the communication panel receptacle 41, so as to insert the present invention in the nurse call system. In this manner, the functions of the present invention are capable of being achieved without the necessity of adding additional wiring or the like in hospital rooms or convalescent homes. The present invention does not operate to actuate an alarm, such as an indicator lamp 22 at a central station whenever a patient moves from engagement with the pressure-operated switch 33 of the present invention. This movement may occur as a result of the patient falling or climbing from a hospital bed.

An operator at a central station is provided with the capability of determining whether or not the patient has merely called for assistance by actuating a nurse call button or switch 16 or whether the patient has absented himself from the bed or unplugged the system. When the lamp 22 lights up at the central station, the operator need only close the switch 47 to determine whether or not it is the nurse call button 16 that has energized the lamp. If the lamp goes out upon closing the switch 47, then the alarm or indication was produced by actuating the nurse call button. If the lamp does not go out upon the pressing of switch 47, the patient has either absented himself from the bed or chair in which the switch 33 is placed or has unplugged the nurse call system. The present invention will thus be seen to be highly advantageous with the addition of a minimum amount of equipment and cost to a conventional system which is normally available. Many problems of patient's care are overcome by the present invention in a simple and economic manner.

The present invention has been described above with respect to a single preferred embodiment thereof, however, it will be apparent to those skilled in the art that numerous modifications are possible, and thus it is not intended to limit the invention of the present terms of description or detail of illustration.

What is claimed is:

1. In a nurse call system having a plug adapted for attachement to a receptacle, said plug having a shorting connection for completing an electrical alarm circuit that activates an alarm when not completed, the improvement comprising a flat pressure actuated switch adapted for disposition on a hospital bed, an electrical connector adapted for insertion between said plug and receptacle, and having separated terminals in a wire normally connecting said alarm circuit via said shorting connection; and means connecting said pressure-operated switch across said terminals of said connector to complete said electrical circuit only when said switch is pressure activated.

2. In the system of claim 1, the improvement comprising an on-off switch mounted in said electrical connector and electrically connected across said terminals with an actuator extending exteriorly of said connector for by-passing said pressure actuated switch to complete said alarm circuit.

3. In the system of claim 1, the further improvement comprising a plurality of electrical connections through said electrical connector between ends thereof for completing circuits of said nurse call system.

4. A hospital bed monitor system adapted for use with a nurse call system having a nurse call button connected to a plug arranged for mating with a receptacle to activate a first alarm circuit upon button actuation and activate a second alarm circuit upon electrical disconnection of plug from receptacle and comprising, an electrical connector adapted for insertion in said receptacle and to receive said plug inserted therein for completing circuits therebetween, said connector having internal wires extending from opposite ends of the connector for completing said second alarm circuit and said wires extending in insulated relation to each other from said connector, and a flat pressure-operated switch connected across said wires extending from said connector, and adapted for disposition on a hospital bed so that the presence of a person in the bed closes the switch to deactivate said second alarm circuit and removal of the person releases the switch to activate said second alarm circuit.

5. The system of claim 4 further defined by said pressure-operated switch comprising a flat waterproof mat having internal contacts that are engaged with each other upon the application of pressure to the exterior of the mat.

6. The system of claim 1 further defined by said connector having a plurality of male prongs extending from one end thereof with female receptacles extending into a second end thereof with orienting means at both ends for engagement with said plug and receptacle in predetermined orientation to complete the alarm circuits of said nurse call system.

* * * * *